US010139153B2

(12) United States Patent
Furr

(10) Patent No.: US 10,139,153 B2
(45) **Date of Patent: *Nov. 27, 2018**

(54) FOOD STORAGE SYSTEM AND METHOD

(71) Applicant: Melody Ann Furr, Cumming, GA (US)

(72) Inventor: Melody Ann Furr, Cumming, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/134,296

(22) Filed: Apr. 20, 2016

(65) Prior Publication Data

US 2016/0231048 A1 Aug. 11, 2016

Related U.S. Application Data

(63) Continuation of application No. 14/512,416, filed on Oct. 11, 2014, now Pat. No. 9,353,989.

(51) Int. Cl.
*F25D 25/02* (2006.01)
*F25D 23/02* (2006.01)
(Continued)

(52) U.S. Cl.
CPC ..... *F25D 25/025* (2013.01); *A47B 47/0091* (2013.01); *A47B 88/407* (2017.01); *F25D 23/00* (2013.01); *F25D 23/025* (2013.01); *A47B 88/919* (2017.01); *A47B 2210/06* (2013.01); *A47B 2210/08* (2013.01);
(Continued)

(58) Field of Classification Search
CPC .... F25D 11/003; F25D 17/042; F25D 17/045; F25D 2323/0021; F25D 2600/04; F25D 23/02; F25D 23/025; F25D 25/025; F25D 25/005; A47B 96/00; A47B 96/04; A47B 95/00; A47B 95/02; A47B 88/04; A47B 2095/024; A47B 2095/026; A47B 2210/08; A47B 2088/0011; B65D 25/02; B65D 77/046; B65D 21/0233; B65D 21/02; B65D 77/0453; B65D 77/0446; B65D 77/04; A45C 11/20
See application file for complete search history.

(56) References Cited

U.S. PATENT DOCUMENTS 2,211,660 A 8/1940 Kidd et al.
2,246,342 A 6/1941 Brown
(Continued)

FOREIGN PATENT DOCUMENTS

WO 2008037017 A1 4/2008

*Primary Examiner* — Andrew M Roersma
(74) *Attorney, Agent, or Firm* — John C Merchant

(57) ABSTRACT

A system for easy organizing and storing of food items within a refrigerator or cooling unit comprising one or more stackable modular assemblies each having a housing unit and one or more slidably insertable drawers having flexible substantially transparent or translucent drawer covers and are configured for containing a variety of rearrangeable and removeable food storage trays. Each housing is vented to increase air circulation at drawer bottom, sides and back. Each drawer is easily removeable from the housing and may be used as a serving tray. Each drawer cover may be positioned on the peripheral support edge of the drawer to seal the drawer as well as the open trays positioned therein without inhibiting movement of the drawer within the housing. A user can easily identify food within the drawer, partially slide the drawer from the container, and lift the drawer cover to access food items quickly.

19 Claims, 7 Drawing Sheets

(51) Int. Cl.

| | |
|---|---|
| ***A47B 47/00*** | (2006.01) |
| ***A47B 88/40*** | (2017.01) |
| ***B65D 77/04*** | (2006.01) |
| ***F25D 23/00*** | (2006.01) |
| ***A47B 88/407*** | (2017.01) |
| *A47B 88/919* | (2017.01) |

(52) U.S. Cl.
CPC ..... *A47B 2210/19* (2013.01); *B65D 77/04* (2013.01); *F25D 2325/021* (2013.01)

(56) References Cited

U.S. PATENT DOCUMENTS

| | | | | |
|---|---|---|---|---|
| 2,695,115 | A | 11/1954 | Roop | |
| 2,763,526 | A * | 9/1956 | Falek | A47B 88/0003 312/270.3 |
| 2,988,412 | A | 6/1961 | Vannice | |
| 3,295,904 | A | 1/1967 | Cobb | |
| 3,394,861 | A | 7/1968 | Truax | |
| 3,490,823 | A | 1/1970 | Bardeau et al. | |
| 4,314,650 | A | 2/1982 | Cillario | |
| 4,735,318 | A | 4/1988 | Keffeler | |
| D297,688 | S | 9/1988 | Solomon et al. | |
| 5,016,756 | A | 5/1991 | Wischhusen et al. | |
| 5,027,972 | A | 7/1991 | Bartholomew | |
| 5,116,240 | A | 5/1992 | Wischhusen et al. | |
| 5,123,564 | A | 6/1992 | Hobson | |
| 5,344,024 | A | 9/1994 | Cohu | |
| D367,381 | S | 2/1996 | Licari | |
| 5,547,098 | A | 8/1996 | Jordan | |
| 5,680,957 | A | 10/1997 | Liu | |
| 5,820,239 | A | 10/1998 | Christenson et al. | |
| 6,352,170 | B1 | 3/2002 | Brown et al. | |
| 6,488,463 | B1 | 12/2002 | Harris | |
| D536,738 | S | 2/2007 | Smith | |
| 7,326,428 | B2 | 2/2008 | Weir | |
| 7,350,886 | B2 | 4/2008 | Antos et al. | |
| 7,472,974 | B2 | 1/2009 | Czach et al. | |
| D591,111 | S | 4/2009 | Rzeczkowski | |
| 7,718,924 | B2 | 5/2010 | Claffy | |
| 7,784,398 | B2 | 8/2010 | Matus | |
| 7,891,493 | B2 | 2/2011 | Dege et al. | |
| 7,997,438 | B2 | 8/2011 | Kelly | |
| 8,196,771 | B1 | 6/2012 | Gathings | |
| 2004/0129707 | A1 | 7/2004 | Weir | |
| 2004/0262319 | A1 | 12/2004 | Fisher | |
| 2008/0138477 | A1 | 6/2008 | Mular et al. | |
| 2008/0265733 | A1 | 7/2008 | Hue et al. | |
| 2009/0162506 | A1 | 6/2009 | Weir | |
| 2011/0163053 | A1 | 7/2011 | Benneche et al. | |
| 2011/0180544 | A1 | 7/2011 | Frank | |
| 2011/0240653 | A1 | 10/2011 | Castner et al. | |
| 2011/0284555 | A1 | 11/2011 | Barringer et al. | |
| 2012/0079845 | A1 | 4/2012 | Hong et al. | |
| 2012/0126680 | A1 | 5/2012 | Lee et al. | |
| 2012/0181910 | A1 | 7/2012 | Kim | |
| 2013/0024468 | A1 * | 1/2013 | Kocsis | B65D 77/0446 707/758 |

* cited by examiner

FOOD STORAGE SYSTEM AND METHOD

CROSS-REFERENCE TO RELATED APPLICATION

The present non-provisional Application claims the benefit of the prior filed commonly assigned Non-provisional Application having Serial No. provisional Application having Ser. No. 14/512,416 entitled FOOD STORAGE SYSTEM AND METHOD which prior filed Application claimed the benefit of 61/890,230, filed on Oct. 12, 2013, and entitled EASY ACCESS MODULAR STORE AND SERVE ORGANIZING SYSTEM, which prior filed Non-Provisional Application and Provisional Application are incorporated herein by reference in their entirety.

FIELD OF THE INVENTION

The present invention relates generally to a modular food storage and organizing system adapted for storing and organizing food items within a refrigerator or other cooling unit.

BACKGROUND OF THE INVENTION

The organization and retrieval of food stored in the common refrigerator or cooling unit is problematic for the average user who must rely on the large built-in drawers to accommodate specific items or otherwise fit variously sized food containers on shelves or racks. Food items are stuffed in drawers and hidden from view or are pushed back to the rear of shelves to become lost, forgotten, spoiled or spilled. Users who may know where a particular food item is stored may have significant difficulty accessing that item easily. And organization of the various bulky or half full food containers within the refrigerator or cooler can be a surprisingly difficult task. The vertical space on any given refrigerator shelf is often haphazardly or inefficiently utilized because of all the hastily stacked, bulky, slippery, or cumbersome foods and/or food containers that must be stored on each shelf. As a result, a great deal of food is wasted or spoiled. And users waste significant time looking for and retrieving items.

A variety of storage containers have been designed in an attempt to make food storage and retrieval more effective and efficient Common examples of storage containers include plastic containers with collapsible lids, multi-sized and shaped lid/container combinations for covering and stacking, dome-shaped covers for covering ordinary serving plates or bowls, and ethyelene absorbing bags for storing and keeping fresh vegetables and fruits fresh. But container or bags often clutter the refrigerator storage space and make it difficult for the user to identify the food contained therein. The different sizes and shapes make them difficult to organize. Soft topped containers are susceptible to being crushed. Stacked items are not easily removed and replaced. And systems designed to fit within refrigerator drawers are often inaccessible without pulling out the entire drawer. Users with restricted movement (particularly children, disabled, or elderly persons) have difficulty accessing the food containers or otherwise setting them back in the refrigerator.

While prior art systems have been invented to alleviate problems, they also have significant drawbacks. For example, International Publication WO20008/037017 (inventor McDonald, published Apr. 3, 2008) discloses a food storage container assembly having a large open top container (or body) housing two removeable containers and having an elastomeric lid which seals the open top as well as the open tops of the internal containers. This system is not easily utilized as the assembly is not easily accessible and the lid does not adequately seal both the open top container and the removeable containers stored therein. Similarly, U.S. Pat. No. 7,326,428 (inventor Weir, 2008) discloses a divided container system comprising a master tray with interior bottom surface designed to receive at least one insertable subtray to one or more committed spaces within the master tray, and a lid for sealing both the master tray and subtrays utilizing a grid/groove structure on the bottom surface of the lid. The design creates the extra difficulty of having to "fit" each subtray into the receptacle portion of the master tray which is particularly difficult for persons lacking fine motor skills or having visual limitations (and is particularly difficult for children and disabled persons to use). The system is also difficult to clean because of the grid protrusions/grooves in the surfaces of the master container and lid which catch food and must be scrubbed clean. The master and sub-tray approach does not alleviate the problem of finding a place within the refrigerator or cooling unit to place the master tray. Further, it does not accommodate the use of bowls or containers which might not be part of the system (i.e. containers which might be of different sizes or not conforming with the grooves in the master tray and lid). While the system is stackable, one must remove the top tray to access the tray stacked underneath. U.S. Pat. No. 5,016,756A (inventor Kehlbeck, filed Jun. 1, 1989) also discloses a multi-partitioned food storage and serving apparatus which providing compartmental storage capability utilizing bowls, cavities and partitions. Unfortunately, the system has all drawbacks associated with cleanup, storage and utility as the similar systems described above.

The prior art food storage containers and systems described above fail to provide adequate solutions to the problem of easily and efficiently storing food within a refrigerator or cooling unit.

SUMMARY OF THE INVENTION

In accordance with the present invention, a modular food storage system is provided which resolves problems associated with the prior art systems and methods of organizing, storing, and displaying food items within a refrigerator or other cooling unit. The inventive system includes one or more modular assemblies each having a stackable housing unit containing one or more slidably insertable and removable drawers configured for containing one or more rearrangeable and easily removable food storage trays. Each drawer is configured to accept an easily removable drawer cover which may be positioned on the drawer peripheral support edge to seal the drawer as well as the one or more food trays stored within each drawer. Each housing is vented to allow circulation of air to the drawer bottom, sides and back. The housing unit is configured to accept the slideably insertable drawers such that the top peripheral edge of each drawer is approximately near the interior top surface of the housing unit to allow some air to circulate into the drawer interior keeping foods fresh when the drawer cover is not in use without allowing so much circulating air into the drawer storage space as to increase dehydration or spoilage of food stored therein. In some embodiments, the drawers and drawer covers are translucent to allow the user to identify food items stored within the drawer without having to pull the drawer out and lift the drawer cover. Preferred embodiments of the drawer covers are flexible and transparent with horizontal supports that prevent sagging while maintaining flexibility. The system provides for storage of a variety of tray configurations within each drawer. All components of the modular assemblies are made of materials which are light, strong and easily cleanable. The top exterior surface of each unit may be utilized as additional shelf space.

The system is configured for use within a refrigerator, other cooling unit (such as a bin cooler) or on a countertop. The configuration provides for an assortment of foods to be stored separately in the various drawers, trays, or by utilizing dividers, all concomitantly under one lid thus utilizing space which might otherwise be taken up by bulky containers and packaging. The user organizes and stores the food within the drawers and trays. The food can be easily accessed by pulling the handle to slide the drawer from the housing unit, lifting the drawer cover and accessing the food stored within the drawer and/or trays arranged within the drawer. In some embodiments, the assembly also includes tray lids for preventing spilling or spoilage of foods stored within the trays and drawer.

Each modular assembly (housing unit, drawers, drawer covers, and trays) may be used separately or as a system of multiple modular units which may be stacked and/or otherwise connected with one another using various clips, pins or other fastening means.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
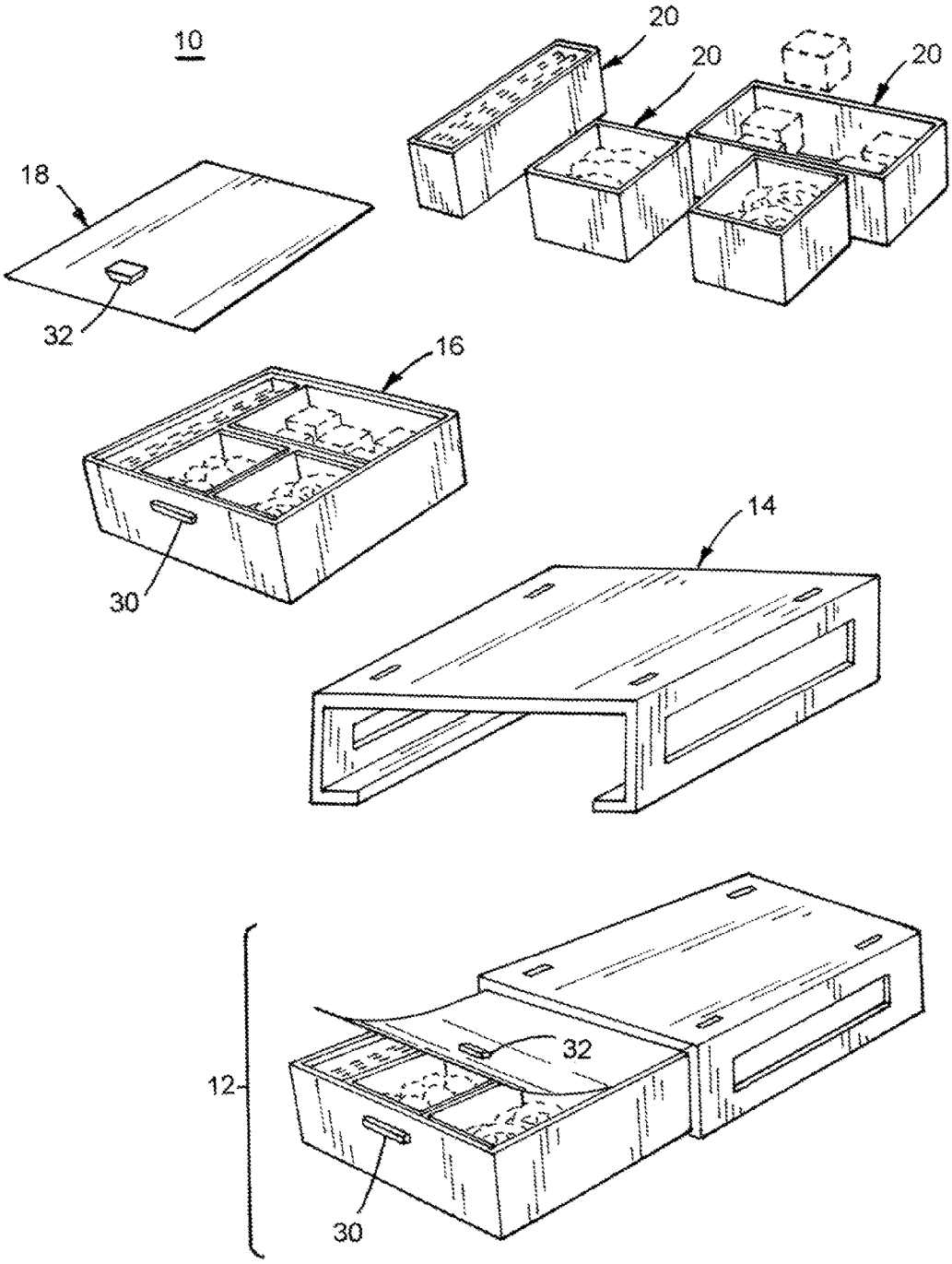
FIG. 1 contains perspective views of various components of the storage system including embodiments of a housing unit, drawer, trays and lift-able drawer lid, shown separately and in combination.

The Figures are for purposes of illustrating several embodiments of a food storage system embodying the principles of the present invention and are not for purposes of limiting the same. Like reference characters indicate corresponding elements throughout the several views.

FIG. 1 contains perspective views of various components comprising an embodiment of the food storage system 10. The storage system 10 is comprised of one or more modular assemblies 12, each having a housing unit 14, one or more drawers 16 with drawer cover 18, and a variety of trays 20 shown separately and in combination. Each of the components shown is separable from one another and may be used in different combinations for different purposes. While each modular assembly 12 generally consists of a single housing unit 14, a drawer 16 with drawer cover 18 and multiple trays 20 of various sizes, alternative embodiments may consist of a single housing unit configured to accommodate two or more drawers having one or more covers and one or more trays. Further, each modular assembly may accommodate alternative components described herein but not shown in the Figures such as containers designed specifically to accommodate common food items. For example, containers specifically designed to hold eggs (such as covered form of the standard egg carton or, alternatively, a sufficient space to "garage" a carton of eggs) or liquid (such as a bottle, thermos or tray designed to maintain stability of bottles stacked upright or side by side) may be connected with the housing unit or, in the case of smaller alternative components, otherwise inserted within the drawers or trays. Each modular assembly 12 may be used alone, stacked, positioned side by side, or otherwise removeably attached or permanently secured to one another and/or to the refrigerator (or cooling unit) using clips and other devices known in the industry.

Each modular assembly 12 preferably has dimensions that allow one or more assemblies to be easily placed within the main storage compartment of a standard refrigerator or cooling unit. For example, the approximate dimensions of the housing unit might be 13½" (L)×10" (W)×3½" (H) for a wider unit and 13½" (L)×6½" (W)×3½" (H) for a narrower unit. The corresponding exemplar approximate dimensions of a drawer to might be 12½" (L)×9½" (W)×2⅝" (H) for use with a wider housing unit and 12½" (L)×6" (W)×2⅝" (H) for use with a narrower housing unit. In some embodiments, for example, the drawer handle may extend approximately ¾" from the front of the drawer which would make the drawer that much longer for such embodiments. The interior (storage space) of each drawer 16 preferably has dimensions that allow it to accommodate individual insertable and removeable trays 20 of various sizes. In addition, the trays 20 are preferably sized to be placed adjacent to one another to maximize the holding space of the drawer. Alternatively, one or more of the trays 20 may be removed to allow for the storage of items that might be too large to be accommodated by a tray (such, for example, as celery stalks) or are otherwise individually packaged items (such as, for example, cheese wrapped in plastic sheeting).

The interior bottom surface of the drawer 16 and bottom surface of the drawer cover 18 are substantially smooth, offering no grooves or other protrusions which might prevent the use of odd sized bowls or trays. In other words, the system is accommodating to bowls and trays which the user may already have on hand. In alternative embodiments, the drawers may accommodate dividers to separate food items within the drawer storage space (and may optionally be used with trays). These dividers may be removable and or positionally adjustable (for example, positioned within corresponding vertical grooves in the side walls and back), and used to quickly "scrape" over some food items within the drawer to make room for other items. However, the invention contemplates dimensions of the drawer 16 and trays 20 relative to each other to maintain the flexibility discussed above, while maximizing the number of trays that a drawer may accommodate. For one example, a drawer may have dimensions of "6y" in length and "5y" in width, where "y" represents a value slightly higher than the measurement of one side of the smallest trays that would typically be used in a particular assembly. If, for instance "y" is 2", a drawer could have a length of 12" and a width of 10", providing for trays having length and width dimensions that are multiples of 2" in order to occupy the total interior area of the drawer. The multiplier (i.e., "y" in the above example) may be the same in both the length and width dimensions to provide the maximum flexibility for arranging trays within a single drawer, since the trays can be oriented in either direction. Alternatively, the multiplier in the length dimension may be different than the multiplier in the width dimension, which may require additional user manipulation and positioning to optimally arrange trays within one or more drawers slideably positioned within a single housing unit.

Figure 2A:
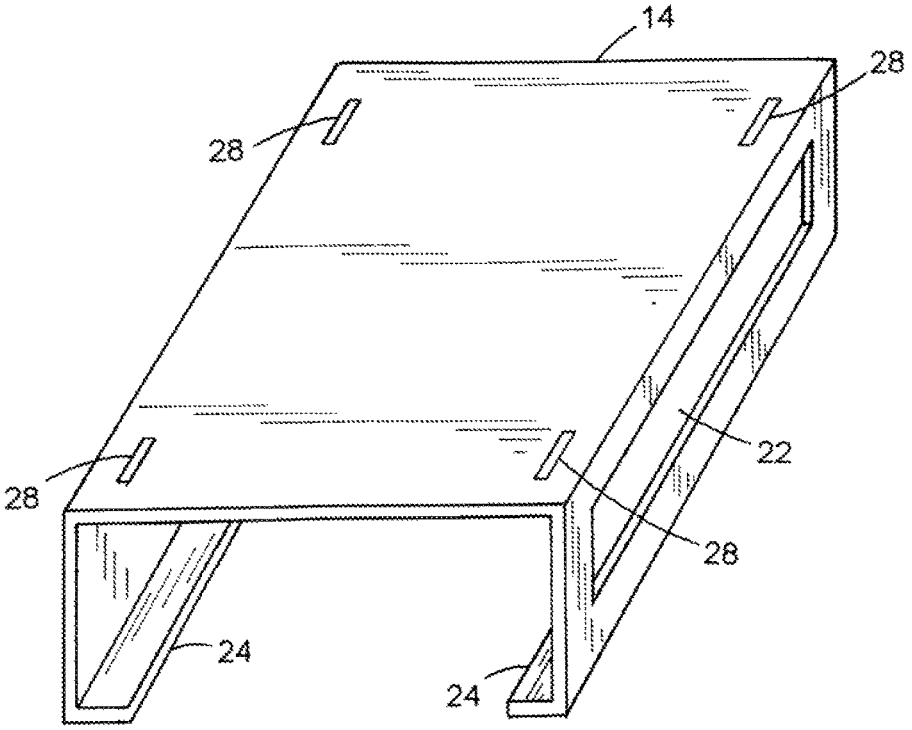
FIGS. 2A and 2B contain top and bottom perspective views of two embodiments of a housing unit consistent with the principles of the present invention.
Figure 2B:
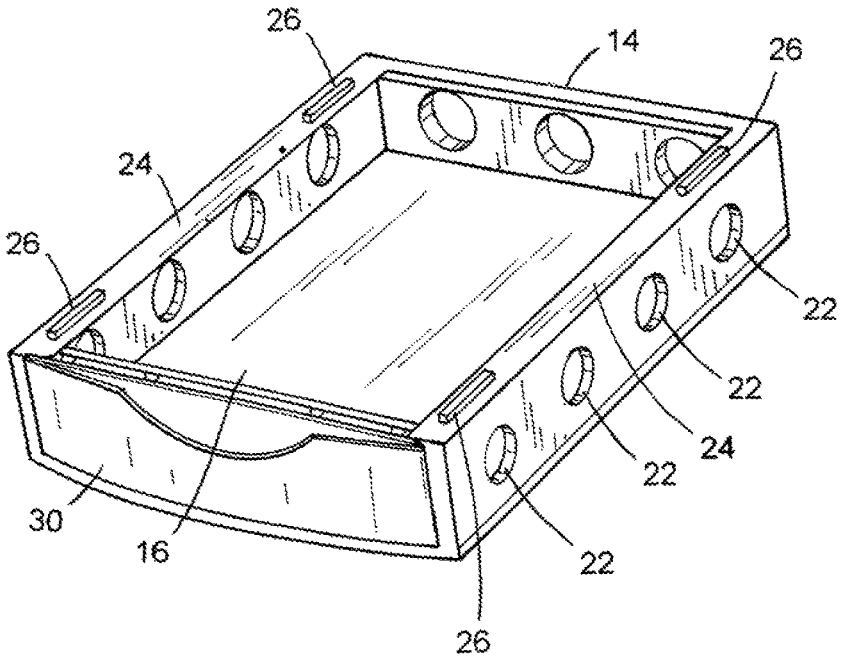

FIG. 2A is a top perspective view of an embodiment of the a housing unit 14 consistent with the principles of the present invention. The embodiment of the housing unit 14 shown in FIG. 2A is configured to accommodate a single drawer 16 while alternative embodiments of a housing unit may accommodate more than one drawer. FIG. 2B is a bottom perspective view of an alternative embodiment of a housing unit 14 consistent with the principles of the present invention. The housing unit 14 shown in FIG. 2A is empty. The alternative embodiment of the housing unit 14 shown in FIG. 2B has a drawer 16 having a clear bottom panel inserted in the housing 14 with an alternative embodiment of a drawer handle 30 partially covering the front opening of the housing.

The top, bottom, front, back, and sides of the housing unit 14 embodiments shown in FIGS. 2A and 2B have exterior and interior surfaces and define an interior space, the front having an opening configured to accommodate the insertion of one or more drawers 16 with drawer covers 18 therein. Again, FIG. 2B shows an embodiment of a unit 14 with a drawer 18 inserted therein. The embodiments of the housing unit 14 shown in both FIGS. 2A and 2B have substantially parallel sides with vents 22 at each of the sides and back. The vents are positioned between the top and bottom edges of each side of the housing to allow air to flow through to the side of the drawer to be positioned therein. The embodiments shown in FIGS. 2A and 2B have a bottom which is substantially open and which consists primarily of flanges 24 extending inward and longitudinally along each side. The flanges 24 shown in FIGS. 2A and 2B extend continuously from the front to back of the housing unit 14 as shown. Alternative embodiments may have a substantially open back with flanges or stops extending inward from the sides or stops extending above the flanges to prevent a drawer 16 from extending beyond the back of the housing unit when the drawer is inserted therein. Some alternative embodiments may have a closed bottom with vents.

The housing unit may have feet 26 (consisting of pegs, bumps, raised rails or other similar extrusions) extending downward from the exterior bottom surface preferably from the bottom surface of the flanges or bottom corners of the housing unit (See FIG. 2B). These feet may be made of non-skid rubber or similar material as to provide stability when the housing unit is positioned on a smooth surface (such as a refrigerator shelf). To provide for secure stacking of assemblies (one on top of the other), the top exterior surface of the housing unit may have corresponding receptacles 28 (such as indentations, holes, grooves and the like) designed to accept the feet 26 of a housing unit 14 stacked on top. Alternative embodiments of the feet 26 of various sizes and shapes with corresponding receptacles 28 are contemplated, for example circles, rectangles, raised rails, squares, stars.

Each modular assembly 12 can be stacked, grouped vertical and/or horizontally, and otherwise removeably attached to one another using various temporary mating mechanisms such a clips, "mating pegs", removeable straps (with, for example, Velcro hook and loop type ties), or like devices known in the industry. Each assembly 12, as a modular unit, is designed to use separately or in tandem with other assemblies of the same or alternative embodiment.

Alternative embodiments of the housing unit 14 may accommodate temporary or permanent attachment of the assembly 12 to a refrigerator shelf or interior refrigerator (or cooling unit) wall. Such alternative embodiments may accommodate temporary (or removeable) attachment means (for example, rails, snaps, buttons, straps, clips and the like) attached with or to the exterior surface of the housing unit with corresponding attachment means mounted with or to a shelf or interior walls of the refrigerator. An alternative embodiment may include the housing, drawer and drawer cover which is permanently attached to or integrated into a shelf or door. For example, one or more assemblies may be slidably insertable into a shelf rack or other interior portion or component of the refrigerator or cooling unit thus enabling the user to insert and remove the assembly easily. Alternatively, the assembly could be permanently built into the refrigerator or cooling unit.

Each housing unit 14 is designed and configured to allow for circulation of air to the interior space of the housing unit 14 and to the sides and/or bottom of the one or more drawers inserted therein. For this reason, the one or more vents 22 are positioned in the sides between the top and bottom edges of each side and/or at the back between the top and bottom edges of the back side of the housing unit 14 as shown in FIGS. 2A and 2B. The vents 22 allow the air to circulate around the bottom, back, and side exterior surfaces of the one or more drawers inserted therein thus increasing cooling efficiency when the assembly is placed within a refrigerator or other cooling unit. The vents 22 are utilized primarily at the sides, back and bottom of the housing unit and are sized and positioned to enhance air circulation while maintaining the structural stability of the housing unit. While FIG. 2A shows a housing unit with large generally rectangular vents 22 on each side, one or more vents 22 may be positioned thereon in various shapes and sizes. For example, the alternative embodiment of the vents 22 shown in FIG. 2B are circles. Alternatively, the vents 22 may be of a variety of sizes and shapes for example stars, circles, squares or other shapes.

The embodiments of the housing unit shown in FIGS. 2A and 2B have substantially open front sides which are large enough to accommodate insertion of the one or more slideably removeable drawers into the interior space of the unit. The bottom perspective view of the housing unit shown in FIG. 2B shows the front (handle) portion of a drawer 16 positioned therein having a clear bottom to demonstrate how the front of the drawer might fit the opening of the housing unit. The dimensions of the corresponding opening and drawer preferably allows for relatively close proximity of the top interior surface of the housing unit (i.e. the "ceiling underside") with the top peripheral edge of the drawer (i.e. the top edge of the drawer sides) when inserted in housing unit. This relatively close proximity between the top edge of the drawer and the "ceiling" of the housing unit allows some air circulation over the open top of the drawer while diminishing the type of air circulation which might otherwise dehydrate or allow odors to escape from foot items stored within the drawer. While allowance of some air circulation over the top of the drawer is advantageous to preserving certain food items, the proximity of the interior top surface of the housing unit to the open top of the drawer helps maintain food freshness when a drawer cover is not in use. Even when a drawer cover is in use, the gap between the top peripheral edge of the drawer and the interior top surface of the housing unit provides enough clearance for the drawer cover and handle.

Alternative embodiments of the housing unit may define an opening at one or more sides (instead of the front) to accommodate insertion of the drawer. Such approach would not be as efficient from a space saving standpoint as there would need to be space left to the side of the unit to allow for the drawer to be slid in an out and a front oriented loading approach is more efficient for use in a refrigerator where the front is positioned toward the open refrigerator door. Nevertheless, a side opening might be preferable in circumstances where it is necessary to load and remove the drawer from the side instead of the front.

Figure 7:
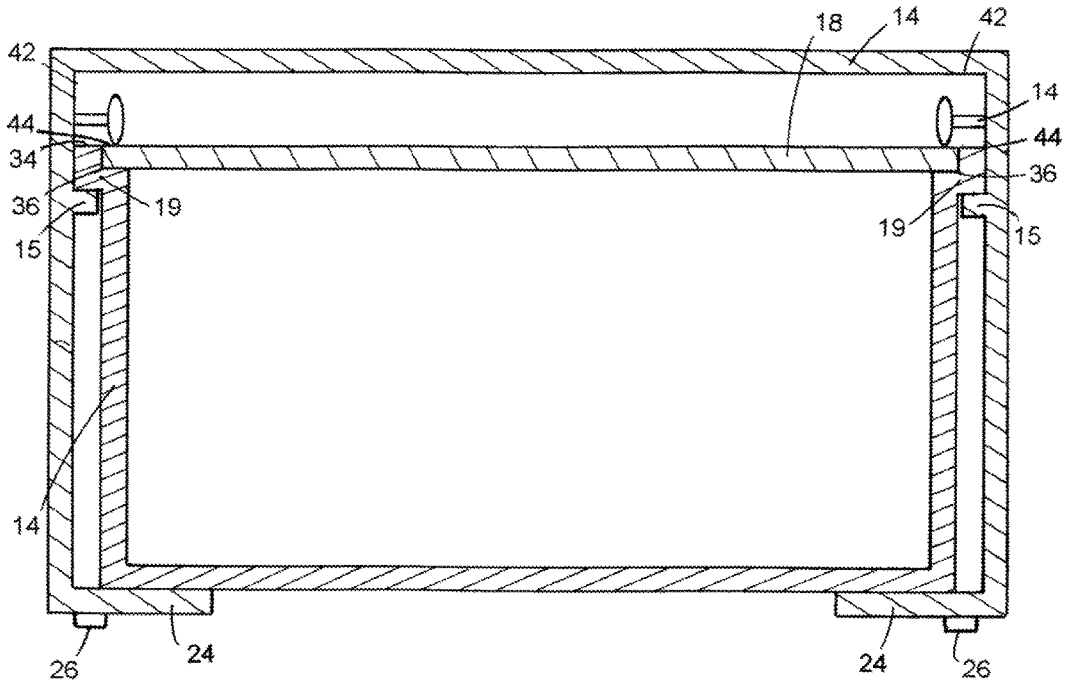
FIG. 7 contains a front side cross-sectional view of a drawer positioned within a housing unit having a drawer cover sealing mechanism consistent with the principles of the present invention.

In alternative embodiments of the housing unit 14 and corresponding drawer 16, the interior side surface of the housing unit has rails 15 running longitudinally along each side approximately ½" to 1" from the top interior surface (See FIG. 7 for front cross-sectional view) These rails 15 are not shown in FIG. 2A or 2B, but are visible at the interior surfaces of the top left and right sides of the embodiment of the housing unit shown in FIG. 7. These rails 15 provide a longitudinal drawer support edge 19 upon which to support the drawers when the drawers are inserted into the housing. FIG. 7 shows the drawer inserted into the housing such that the drawer is supported on the drawer support edge 19 of the rails 15 of the housing when the drawer is inserted within the housing unit.

As previously described, the embodiment of the housing unit shown in FIGS. 2A and 2B have bottom flanges 24 extending inward longitudinally from the sides. These corresponding flanges provide a base upon which the bottom side edges of the one or more drawers may be seated when inserted and slid back into the housing. In embodiments having two or more drawers, each housing unit would require either a center wall running longitudinally from front to back with corresponding rails and/or bottom flanges to adequately support each drawer within the housing unit.

The back of the housing unit may be closed as shown in FIG. 2B. Alternatively, the back may be substantially open to allow additional circulation at the back of the drawer which may be helpful when the housing unit is pushed up against an interior wall of a refrigerator or cooling unit. In such cases when the back is substantially open, it is preferable to have some form of stop extending up from the bottom flange at the back of the unit to prevent the drawers from being slid beyond the back edge of the housing unit when fully inserted therein. Alternatively, the drawer front may flare outward so that the peripheral interior surface of drawer stops at the housing opening. Other approaches to stopping the drawer from sliding beyond the back of the housing are contemplated including providing mesh, bars or other stops at the back which also allow for air circulation to the interior space of the housing unit.

Figure 3A:
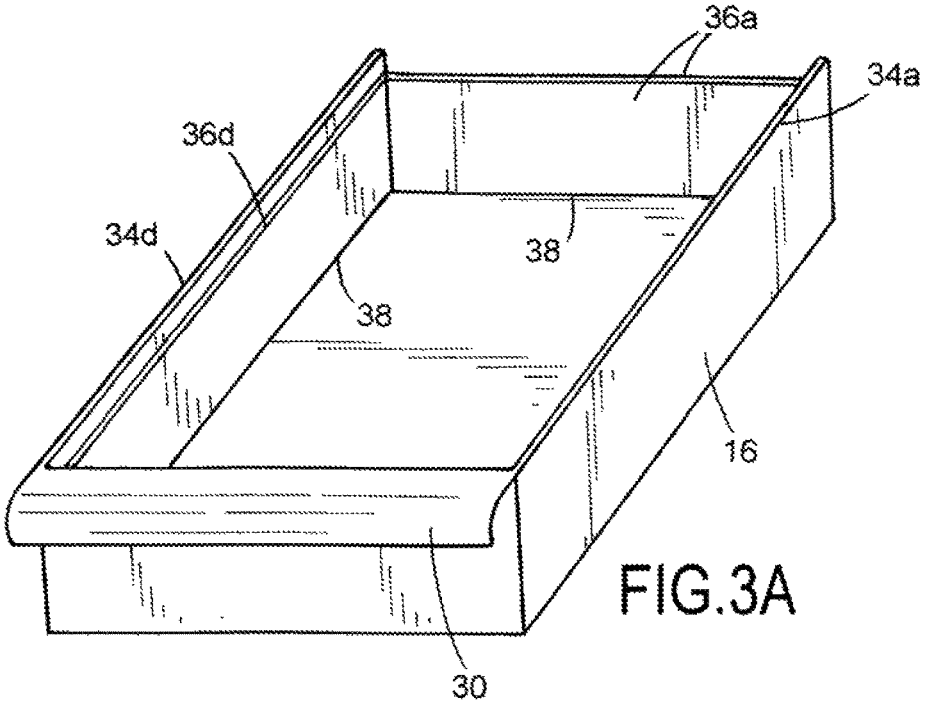
FIGS. 3A and 3B contain top perspective views of an embodiment of a drawer component with and without cover consistent with the principles of the present invention.
Figure 3B:
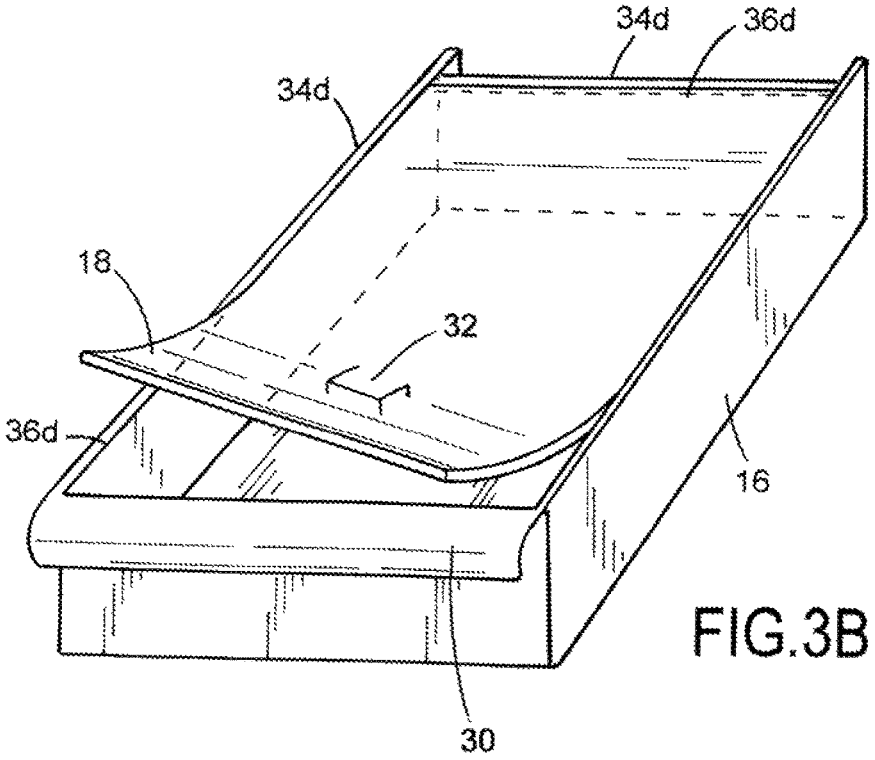

FIGS. 3A and 3B depict separate embodiments of a drawer 16 without drawer cover 18 (FIG. 3A) and with drawer cover 18 (FIG. 3B) consistent with the principles of the present invention.

The drawer embodiment of FIG. 3A, is an open top rectangular container having bottom, parallel sides, back, and a front with interior and exterior surfaces. In this embodiment the front side extends upward and outward to form a drawer handle 30. In alternative embodiments, the drawer handle 30 may be attached directly with the front exterior surface of the drawer (see FIG. 1). Also see that the drawer handle 30 is distinguished from the drawer cover handle 32 which, in some embodiments, may extend from the top surface of the drawer cover 18 (see FIG. 1) or, in alternative embodiments, extend from the front edge of the drawer cover (see FIGS. 5A and 5B). The drawer embodiment of FIG. 3A has back, front, and sides which extend substantially vertically upward from the bottom to define the storage space therein. In alternative drawer embodiments, the back, front and sides may extend upward and outward from the bottom to form a wider circumference at the drawer top peripheral edge 34*d* than at the bottom peripheral edge where the front, back and sides meet the interior bottom surface of the drawer. One will note that the embodiment shown in FIG. 3A has a shortened back which is helpful when utilizing the wheeled self-sealing process described with regard to FIG. 7 below. The drawer embodiment shown in FIG. 3B does not have a shortened back.

The top edge extending around the front, sides and back of the drawer defines the top opening and is referred to herein as the "drawer top peripheral edge" 34*d* while the edge which serves to support the drawer cover when covering the drawer opening (and sealing off the storage space within the drawer) is referred to as the "drawer peripheral support edge" 36*d*. In some embodiments, the drawer top peripheral edge 34*d* also serves as the drawer peripheral support edge 36*d*. In preferred embodiments, the drawer peripheral support edge 36*d* is defined by the interior surface of the front, back and sides just below the drawer top peripheral edge 34*d* allowing enough space for the drawer cover to be supported thereon without the top surface of the drawer cover extending above the drawer top peripheral edge 34*d*.

The embodiments shown in FIGS. 3A and 3B both have has a drawer peripheral support edge 36*d* which extends around the circumference of the drawer interior front, back and sides. It is defined several different ways. For example, it may be an indentation in the interior surfaces of the drawer front, back and sides such that the circumference of the interior walls (front, back, and sides) above the drawer peripheral support edge 36*d* is greater than that below the drawer peripheral support edge 36*d* to allow an approximately ¼" to ⅜" ledge on each side. Or, for example, it may be a rail or "lip" extending inward from the interior surface of the sides and back which provides the approximately ¼" to ⅜" ledge on each side. Regardless, the drawer peripheral support edge 36*d* provides enough support upon which the peripheral edges of the drawer cover may sit and adequately seal the interior of the drawer. The drawer peripheral support edge 36*d* should preferably be positioned far enough below the drawer top peripheral edge 34*d* that the bottom peripheral edge of the drawer cover 18 can be seated (again, effectively "sealing" off the interior space of the drawer) without the top surface of the drawer cover 18 and drawer handle 30 attached thereto extending above the drawer top peripheral edge 34*d*.

In the embodiments of the drawer 14 shown in FIGS. 3A and 3B, the drawer peripheral support edge 36*d* provides a substantially horizontal and uniform surface of approximately ¼ to ⅜" at the front, back and side interior surfaces of the drawer. In alternative embodiments, the drawer peripheral support edge 36*d* may be defined by only two opposing interior surfaces (e.g. front and back, or opposing sides) of the drawer, or alternatively may be defined by three surfaces (e.g. back and opposing sides). In other embodiments, the drawer peripheral support edge 36*d* may be defined by front, back and sides of a drawer intending upward and outward from the bottom at an angle in which case its location (i.e. where the bottom peripheral edge of the drawer cover sits on the drawer) will be defined largely by the circumference of the drawer cover. In alternative embodiments, the drawer peripheral support edge 36*d* will be defined by a bevel in the front, back and sides of the drawer extending downward from the drawer top peripheral edge 34*d*. There are a variety of configurations contemplated with the purpose of supporting the bottom peripheral edge of the drawer cover such that the drawer cover 18 and drawer cover handle 32 to be positioned below the drawer top peripheral edge 34*d* when the drawer is covered. This arrangement allows the drawer 16 to slide easily in and out of the housing unit 14 without the drawer cover 18 or drawer cover handle 32 obstructing movement and is most efficient in that it eliminates the need to provide additional space between the drawer top peripheral and the top interior surface of the housing to accommodate the drawer cover 18 and drawer cover handle 32.

Figure 4A:
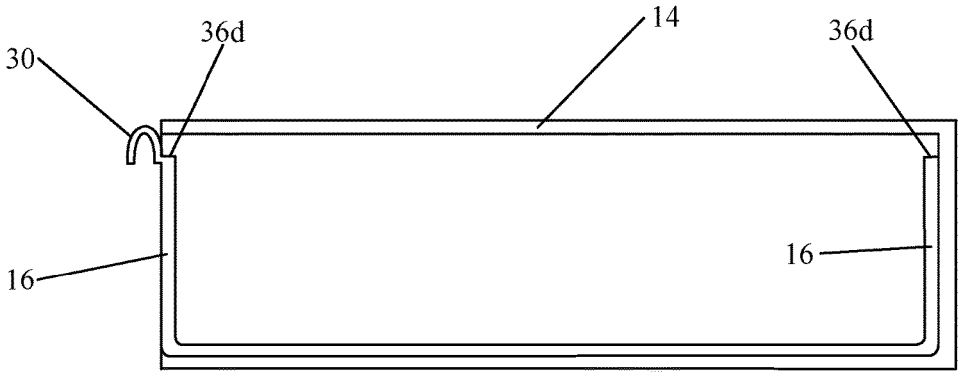
FIGS. 4A, 4B and 4C contain cross-sectional views of an embodiment of a drawer without trays and drawer cover (FIG. 4A), with trays and without drawer cover (FIG. 4B) and with trays and drawer cover (FIG. 4C).

FIG. 4A shows cross-sectional side view of a drawer 16 seated within a housing unit 14. Note that while the drawer peripheral support edge 36*d* is shown, the drawer top peripheral edge 34*d* is not. The drawer is empty and fully inserted within the housing unit 14.

Figure 4B:
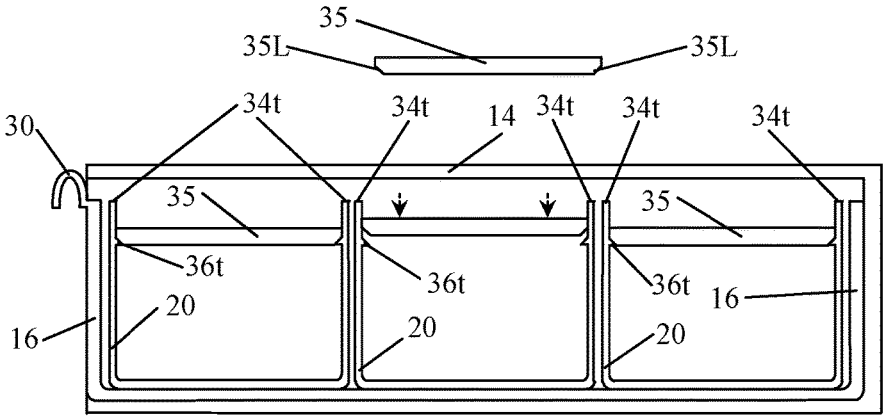

FIG. 4B shows a cross-sectional side view of the same drawer shown in FIG. 4A with several trays 20 positioned within the drawer 16. Note that when the trays are seated on the bottom of the drawer, the top peripheral edges 34*t* of the trays, referred to herein as the "tray top peripheral edge" 34*t*, are the same height as the drawer peripheral support edge 36*d*.

Figure 4C:
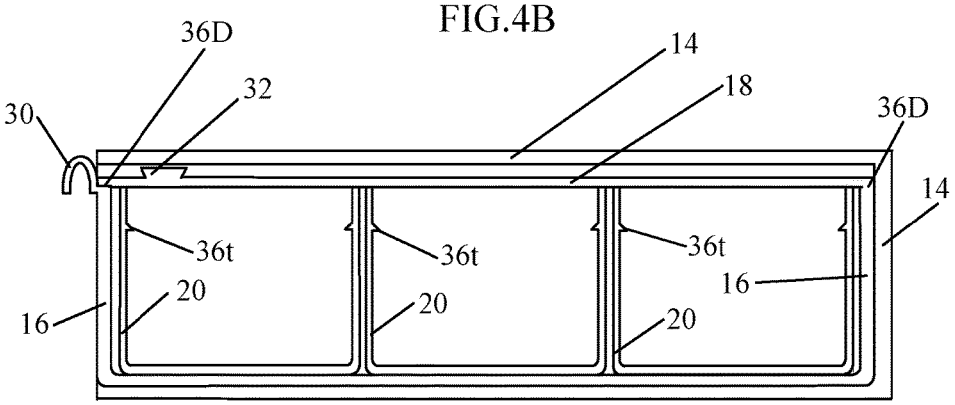

FIG. 4C shows cross-sectional side view of the same drawer and trays shown in FIG. 4B with drawer cover 18 having drawer cover handle 32 seated on the drawer. As shown, the drawer cover 18 is seated on the drawer peripheral support edge 36*d* providing a seal around the drawer peripheral support edge 36*d*. The drawer cover 18 including drawer cover handle 32 are positioned below the drawer top peripheral edge 34*d* (not shown). There is a ½" to ¾" gap between the top of the drawer cover 18 and the interior surface of the top of the housing unit 14 with the drawer inserted completely within housing unit.

An assortment of differently sized and shaped trays 20 can be made available to fit in various combinations within each drawer 16. Thus, a drawer 16 may be adapted for use with a small number of trays 20 (e.g., two or even one sub-tray positioned therein, where such sub-trays can be relatively large) or a larger number of trays (e.g., twelve to twenty more trays positioned therein, where such trays are relatively small). In some embodiments, the trays have separate lids. However, as shown and described above, the trays are designed such that they may be positioned within the drawer 16 with the drawer cover 18 seated on the drawer peripheral support edge 36*d* such that the drawer cover 18 may sit on the drawer peripheral support edge 36*d* as well as each tray top peripheral edge 34*t*, effectively "sealing" the storage space within the drawer 16 as well as the storage space within each tray 20.

In some embodiments, individual tray lids are provided to maintain the contents of the trays or otherwise prevent the contents from spilling. Any of the individual tray lids 35 may have a tray lid peripheral support edge 35L to support the lid so that the top surface of the lid does not extend above the tray top peripheral edge 34*t*. For example, each tray 20 may have a beveled edge (effectively, a tray peripheral support edge 36*t*) that preferably mates with a corresponding beveled edge located at the peripheral edge of the lid 35L allowing the lid to sit down into the tray so that the tray lid does not extend above the tray top peripheral edge 34*t* or the drawer top peripheral edge 34*d*. This arrangement allows the trays, covered by an individual tray lid or not, to be the same height when positioned in the drawer 16 and thus allowing a drawer cover 18 to seal the each tray 20 (with or without lid) without having to compensate for bumps created by tray lids extending above the tray top peripheral edges 34*t*.

A seal between the bottom surface of the drawer cover 18 and a drawer peripheral support edges 36*d* and a trays top peripheral edge 34*t* may be established mainly through pressure between these surfaces, which causes the bottom surface material of a the drawer cover 18 to sit directly on and "seal" the interior "storage space" portion of the drawer 16 and trays 20. In preferred embodiments of the drawer cover 18, the bottom surface of the drawer cover 18 is made of silicone or other relatively deformable material to aid in sealing the drawer peripheral support edges 36*d* and tray top peripheral edges 34*t* when seated thereon. Alternatively, the drawer peripheral support edges 36*d* and tray top peripheral edges 34*t* may be provided with a relatively soft, deformable material to seal against the bottom surface of a drawer cover 18, where such drawer cover 18 could also include corresponding sealing surfaces, or may be a relatively flat surface.

In alternative embodiments, the drawer may have a cover that is snap-fit into place or otherwise fastens onto the drawer top peripheral edges 34*d*. Likewise, each tray 20 may have snap-fit lids and which may extend slightly above the tray top peripheral edges 34*t*. In such embodiments, it may not be necessary that the drawer cover 18 "seal" each individual tray as the snap fit enclosure of the drawer will be enough to seal the contents of the drawer keeping the drawer and tray contents fresh and safe from excess dehydration during storage and before use.

The drawers and trays may be made of a variety of light, durable materials commonly used in the industry for purposes of storing food items within a refrigerator and maintaining ease of cleaning (for example, synthetic resin, plastic, vinyl and other like materials). Drawers and trays having smooth interior and rounded corners will facilitate easy cleaning. Bottom or top surfaces (such as the housing unit top and the top surface of the drawer bottom may have a sanded or pebbled finish to facilitate secure, non-slip gripping. In addition, synthetic resins or other softer materials may be utilized at the top edges of the drawer and trays (as well as the bottom surface of the drawer cover) to enhance fit and sealing. Each tray may be made of thin synthetic resin material for disposal after use, if desired, or may alternatively be made of a more durable material for tray reuse, if desired. The material from which the planar surface of the drawer cover and/or tray lids are preferably made of relatively transparent to allow viewing of the contents of the drawer and trays. All materials of the storage system 10 are preferably approved by the FDA as "food safe" or "food grade" materials. In alternative embodiments, the trays have rounded corners to facilitate easy removal when the drawers are positioned in close proximity to one another as the rounded edges provide a space between adjacently positioned doors to insert a finger and pull out a tray.

Figure 5A:
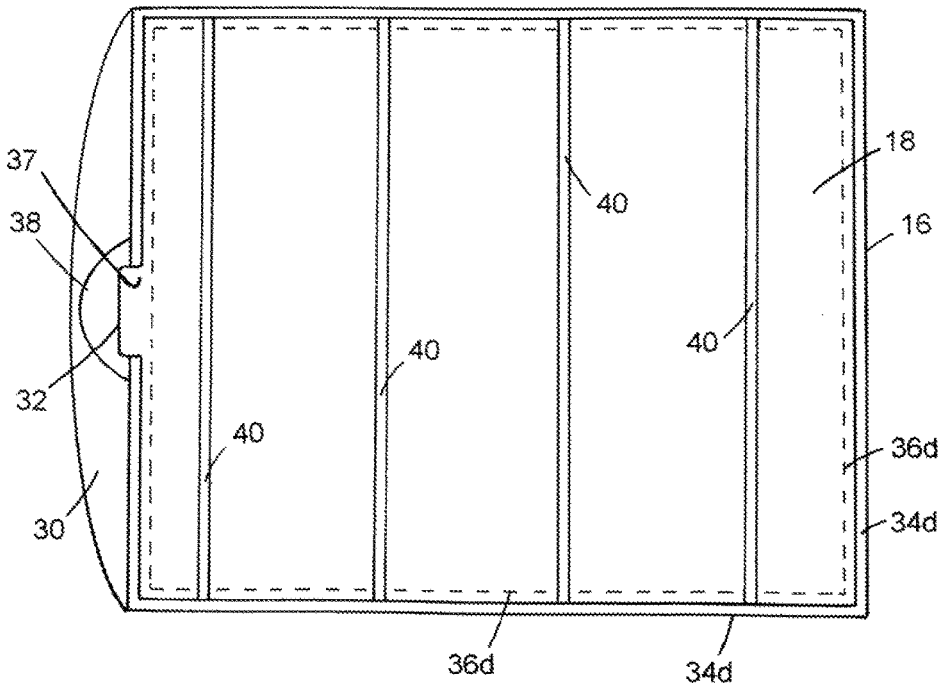
FIG. 5A contains a top view of an embodiment of a drawer consistent with the principles of the invention showing peripheral top edge, peripheral support edge and flexible drawer cover having horizontal supports.

FIG. 5A is a top view schematic view of an alternative embodiment of a drawer 18 having a drawer top peripheral edge 34*d* and drawer peripheral support edge 36*d* (shown with dashed lines) with drawer cover 18 seated thereon. The embodiment shown has an alternative design of the drawer cover handle 32 which is an extension of front edge of the drawer cover 18. This form of the drawer cover handle 32 extends through a notch 37 (or opening) at the drawer top peripheral edge 34*d* the front side of the drawer. In some embodiments, the drawer cover handle 32 may flair outward somewhat on the outside of the drawer notch 37 to provide a temporary latching type attachment to the front of the drawer. The alternative design of the drawer handle 30 accommodates the extending drawer cover handle 32 defining an access opening 38 so that the user may reach in to access the drawer cover handle 32 to lift or replace the drawer cover 18 in the notch 37 at the drawer top peripheral edge 34*d* of the front side of the drawer.

A preferred embodiment of the drawer cover 18 is made of strong flexible material (such as silicone, rubber, vinyl or similar materials) which is substantially transparent or translucent to allow the user to see through and identify the contents of the drawer when the drawer cover is placed on the drawer. In alternative embodiments the drawer front or sides may be substantially transparent (i.e. made of clear plastic) while the drawer cover 18 is substantially translucent (i.e made of substantially translucent silicone or rubber) to allow the user to identify (generally, or specifically) whether food is contained in the drawer. The flexible drawer cover 18 is advantageous in that the user may slide the drawer partially out of the housing, lift up the flexible cover, and peek inside or access the contents of the drawer without sliding the drawer completely out of the housing unit. In order to maintain the seal of the drawer cover on the drawer peripheral edge and guard against any lateral sagging in the flexible drawer cover which may result the drawer cover being unseated at the peripheral support edge, lateral supports 40 are positioned in regular intervals along the horizontal surface of the drawer cover. These lateral supports 40 may be built-in to the drawer cover (in the form of raised horizontal ridges) or may be made of a relatively rigid, light and strong material (such as moldable metal, plastic or hard rubber) which are attached to the top surface of the drawer cover maintaining the structural integrity of the flexible cover 18 even after many uses. In order to assist in making sure the drawer cover 18 is adequately seated on the drawer support edge when in use, alternative embodiments of the drawer may have protrusions extending inward of the interior sides and back of the drawer above the support edge to help keep the cover positioned tightly thereon. For example, rounded protrusions (i.e. "pop-over-the-dots" or other lateral protrusions) may extend from two or more sides of the internal vertical surfaces of the drawer or external vertical surfaces of the trays to help to keep the drawer sealed against the top peripheral edges of the trays when the user closes the drawer cover on the support edge of the drawer or top peripheral edge of the trays.

Figure 5B:
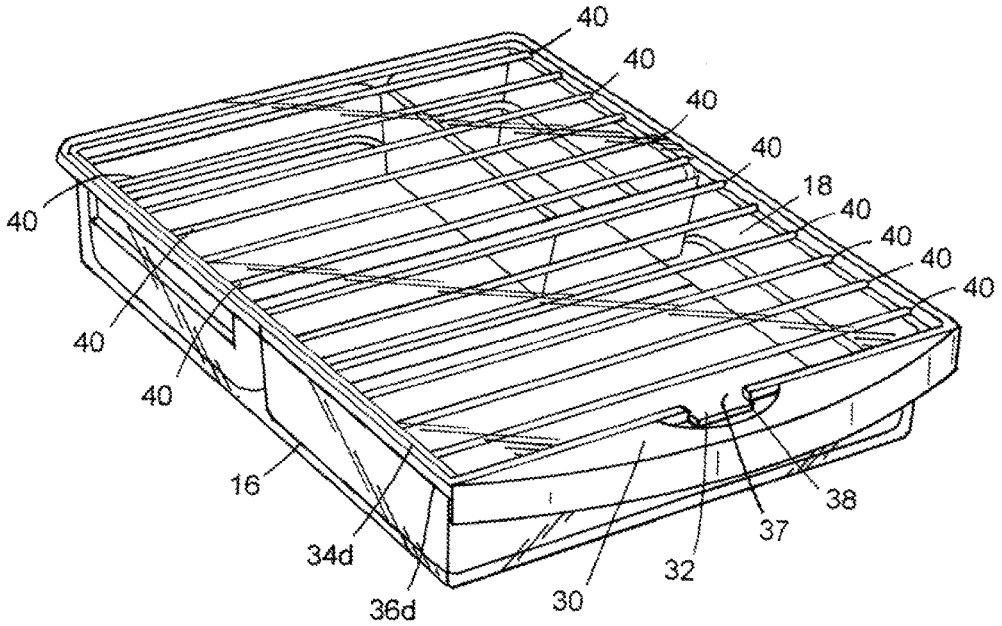
FIG. 5B contains a perspective view of an embodiment of a drawer having ribbed cover and trays positioned therein consistent with the principles of the present invention.

FIG. 5B is a side perspective view of the embodiment of the drawer 16 with flexible transparent drawer cover 18 seated on the peripheral support edge 36 of the drawer such that the drawer cover 18 sits below the top peripheral edge 34 of the drawer. The transparent drawer sides and drawer cover reveal several trays 20 positioned within the storage space of the drawer. The drawer cover 18 seals the top peripheral edges of the various trays as well as the drawer at the drawer peripheral support edge. The drawer cover handle 32 extends from the top front edge of the drawer cover through the notch 37 in front top edge of the drawer. The drawer handle extends outward from the front side of the drawer and provides an access opening 38 providing the user with access to the drawer cover handle 32. The flexible substantially transparent or translucent drawer cover 18 has lateral supports 40 (in this instance "ridges") extending laterally and upwards from the top surface of the drawer cover to diminish sagging and to help maintain the seal at the peripheral support edge 36 of the drawer. In alternative embodiments, the drawer cover 18 may be made of stiff material, such as hard plastic or rubber, and including horizontal creases (or section connections that are flexible or hinged) in order to allow the drawer cover to be lifted up at the front while keeping it substantially seated at the back. In alternative embodiments, the drawer cover may be hinged or otherwise anchored to the drawer itself.

Figure 6A:
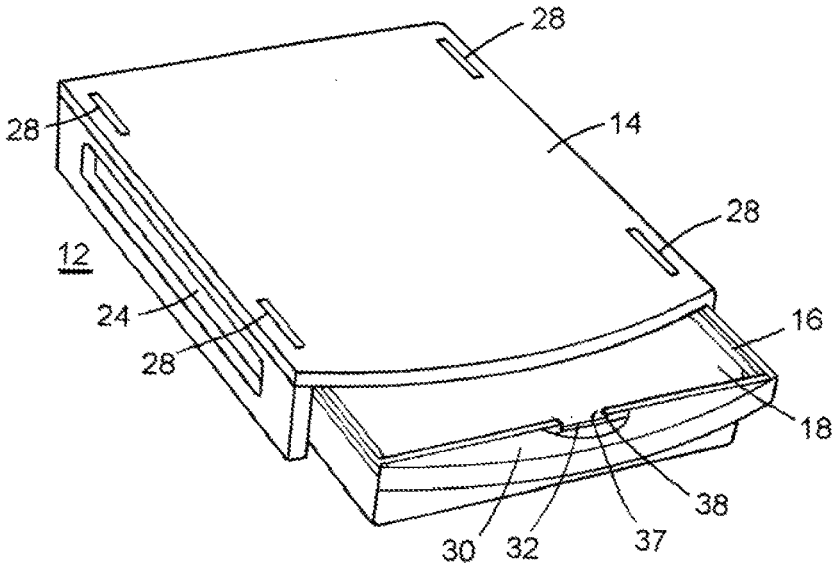
FIG. 6A contains a perspective view of an embodiment of a drawer having smooth cover and alternative drawer handle consistent with the principles of the present invention.

FIG. 6A contains a perspective view of an embodiment of a modular assembly 12 having a housing unit 14 and drawer 16 with seated drawer cover 18 inserted therein. The housing unit has a rectangular vent 24 and feet receptacles 28 for stacking purposes. In this embodiment, the drawer cover is smooth and has a drawer cover handle 32 extending from the front edge of the drawer cover through a notch 37 provided in the front top edge of the drawer. The drawer handle 30 provides an access opening 38 for accessing the drawer cover handle 32. In other words, and as shown in FIG. 6A, the drawer handle 30 defines a space to allow the user to reach in and grasp the protruding drawer cover handle 32.

Figure 6B:
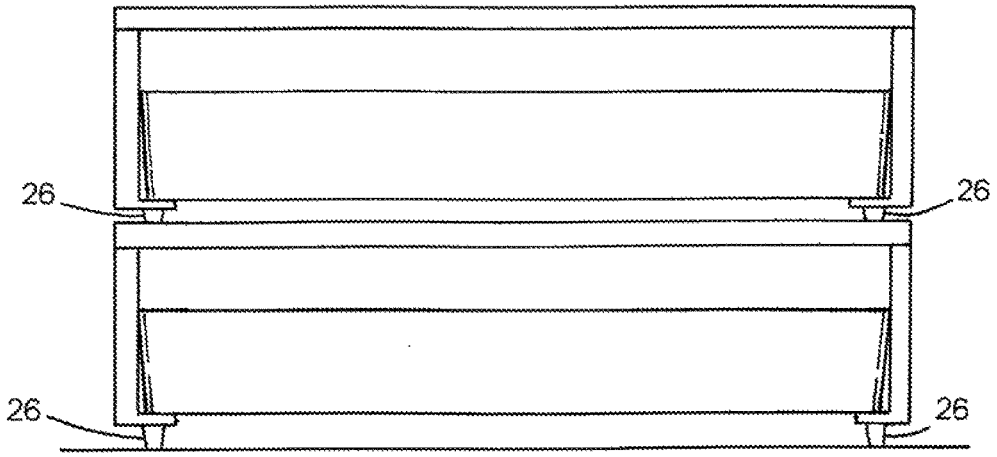
FIG. 6B contains a front perspective view of a stacked embodiment of the storage system consistent with the principles of the present invention.

FIG. 6B contains a front perspective view of the storage system consisting of two assemblies of the embodiment shown in FIG. 6A stacked one on top of the other. The feet 26 extending from the bottom surface of the top housing unit are secured in corresponding receptacles 28 located at the top exterior surface of the bottom housing unit. The feet 26 of the bottom housing unit are positioned on a surface such as a table or shelf.

FIG. 7 shows a front side cross-sectional view of an alternative embodiment of a housing unit 14 and drawer 16 with drawer cover 18 inserted therein. The alternative embodiment of the housing unit 14 has rails 15 running longitudinally along each side approximately ½" to 1" from the top interior surface (See FIG. 7 for front cross-sectional view) These rails 15 extend inward approximately ¼" to ⅜" from the interior side surfaces of the housing unit and serve to provide a support ledge upon which to support the drawers when the drawers are inserted into the housing. As previously noted, the top side edges of the corresponding drawer flare outward into a "lip" which sit upon the support edge 19 of the rails 15 when the drawer is inserted within the housing unit. Positioned above the corresponding rails 15 at each interior side surface of the housing unit 14 are wheels 42 extending from posts 44. As shown, the wheels are positioned at or near the front opening of the housing unit on each side but alternatively multiple wheels may be positioned above the rails and extending back into the housing unit on each side. The wheels 42 provide a mechanism for providing additional pressure to the top side edges of the drawer cover as the drawer is slid back into the housing unit. The additional pressure causes the drawer cover edges to seal more efficiently. In embodiments having the alternative wheel mechanism for providing additional pressure on the drawer cover at the peripheral support edge 36, it is preferable that the back side top edge of the drawer be lower (in other words the back side top edge sit below the top edges of the corresponding sides) to accommodate the wheels as the drawer unit is slid back into the housing unit (See FIG. 3A). Otherwise, the back top edge of the drawer would make it difficult for the drawer to be positioned on the rails of the housing unit with the wheels positioned above the drawer cover as the drawer is inserted into the housing unit.

Each modular assembly can be sized to fit into a portable cooler, or into a smaller refrigerator, such as the type commonly found in a family room, hotel room, dormitory or the like. Each individual drawer may be used as a drawer or separately as a serving dish. In some embodiments, the bottom surface of the drawers are equipped with feet that all the drawer bottom surface to be suspended when the drawer is place on a flat surface such as a counter or table. The feet would be positioned at the corners of the drawer bottom surface to maintain stability but not so close to the edges as to interfere with the drawer sliding easily into and out of the housing unit.

As previously described, each modular assembly can be positioned individually within a refrigerator or cooling unit, stacked, placed side by side, or otherwise temporarily attached to other modular assemblies. Alternative embodiments of the modular assembly can be suspended from a refrigerator shelf in order to keep the area beneath the modular assembly free for storing other refrigerator items. The dimensions for each modular assembly should allow easy insertion and withdrawal of the one or more drawers relative to the dimensions and door opening mechanism of a standard sized refrigerator. For illustrative purposes, dimensions for a modular assembly where the each housing unit is approximately 12" inches in length and varies from approximately 12" to 8" and is approximately 3" to 4" in height would be suitable for most standard sized home refrigerators. A refrigerator or cooling unit may have a specifically manufactured shelf to accommodate one or more modular assemblies allowing easy placement and removal of the entire assembly or just the one or more drawers.

Alternatively an attachment system may optionally be used to suspend and fasten the modular assembly relative to a shelf, such as a refrigerator shelf. Such an attachment system can be an integral part of the exterior surface of the housing unit or may be an attachable and detachable feature. For example, an attachment system may include a pair of opposing rails within the refrigerator or cooling unit and corresponding rail members that attach to the sides of each housing unit so that the housing unit may be slid into position, supported, and removeably attached. With such an arrangement, the entire assembly, including housing unit, may be detached and removed. Or, alternatively, the housing unit may stay attached and the drawer removed. Alternatively the system may be permanently attached to the interior surfaces of the refrigerator or cooling unit such as being integrated into a shelf, drawer system or door.

The top surface of the housing unit can, if desired, have a cutting board surface. The cutting board surface may contain food-compatible iontophoretic materials or bactericides to control bacterial growth. The cutting board can be integral with or removable from the top surface of the housing unit (for example, by snap-attachment).

The top of the housing unit can be fashioned to accommodate attachment of refreezable gel packs, ice sheets or other cooling items to help maintain freshness of the packaged ingredients, when the storage system is used to transport and serve contents without refrigeration.

The drawers and trays may have ethylene-absorbent or antibacterial material to retard food spoilage and bacterial growth.

Although one use for the modular food storage system of this invention is for storage and transport of various food ingredients, a variety of other uses are equally intended to be within the scope of this invention. For one example, the system may be used for storage and transport of medicines and biological materials that should be stored separately but are desirably transported together. Generally, it may be used to store and transport a variety of industrial, food, or medical items that need to be cooled during or after storage.

Method for Using: The inventive modular storage system described herein provides flexibility and efficiency of use with regard to food storage, retrieval, and transport while providing for ease of use and cleaning. The following are examples of use in a typical household.

In one example, the user has a variety of foods which she wants to store in a refrigerator. She arranges one or more of the modular assemblies so that they are stacked on her refrigerator shelf. She utilizes the individual trays for leftovers and other foods otherwise needing a separate container. She may place larger food items (such as fruits and celery) directly in the drawers. She utilizes the drawer cover to cover both the trays and the drawer itself. Some of the leftovers may be warm, and but the user does not worry about the assembly keeping the heat in as the vents all the cooler air to circulate around the drawer and cool the food stored within. A variety of differently sized trays fit within each drawer. The drawer cover serves to seal both the drawer as well as the separate trays. When she wants to remove the food, she may remove the entire drawer from the housing unit of simply pull the drawer handle to partially remove the drawer from the housing unit, lift up the drawer cover to identify the desired tray or food item and remove it. The drawer slides easily back into the housing unit which remains stationary on the shelf.

To further exemplify the versatility of use for different food types and sizes, several food items needing storage may be visualized. Left over pasta may be stored in one tray in a drawer using the a drawer cover to seal both the drawer and the tray for optimal protection from dehydration, or alternatively using a tray lid to keep sauce from dripping out of one tray and storing the pasta in an open second tray. Lettuce pieces freely placed on a paper towel and drainage mat may be stored directly in a drawer. Assorted fruits and salad ingredients (such as onions, parsley, croutons and the like) may be stored in trays or on a paper towel or drainage mat. All the food for a lurch including pasta and salad may be stored in a single drawer. The entire module may be removed and transported, the drawer may be removed or individual trays and stored food items may be removed when needed.

In many common household situations, food has been stored for some time and the user either wasn't the person who stored it or otherwise doesn't remember where it was stored. Using an embodiment of the storage system having transparent front drawers and drawer covers allows the user to see into the drawers to identify food contained therein without having to remove the drawers or drawer cover to look inside.

In another example, the user wants to place fresh groceries in the refrigerator. She pulls out the drawer part way and quickly places a cluster of five tomatoes in the drawer. She does not use the drawer cover as some foods (such as tomatoes) are better preserved a non "air tight" environment. The housing unit provides enough insulation from circulating air to make sure the tomatoes do not take on odors from other foods while providing enough circulation to preserve freshness.

In another example, a user wants to store and later transport a fragile item (such as a pie). She stores the pie in a drawer with drawer cover on. When she wants to transport the pie, she may remove the drawer and take it with her. If she wants to make sure the pie is fully protected in transport, she may remove the entire assembly and transport the pie in the drawer with drawer cover inserted within protective rousing. In an alternative embodiment, the drawer with drawer cover may be removed and transported (with or without trays) in a travel case (such as a thermal rectangular insulated zip up bag) preserving food safety practices for cold or warm storage outside the refrigerator or cooling unit.

In another example, an item recommended for refrigerated thawing (such as frozen raw meat) can be placed in a covered drawer without the worry that other food items adjacently stored would be contaminated.

When a flexible drawer cover is used to cover a drawer containing a variety of trays (some having lids and some not), the cover fits snugly over the top of the trays to seal them. When the drawer cover is not in use, a gap of approximately ⅜" is present between the top peripheral edge of the trays and the interior top surface of the housing unit (with drawer seated fully within the housing unit) allowing some circulation of air. In alternative embodiments, the air circulation at the top of the drawer can be minimized (i.e. substantially closed). Materials known in the industry, such as silicone, rubber or even plastic brush material may be attached with surfaces of the drawer (such as the top peripheral edge of the drawer) which come in close proximity with the sides and top interior surface of the housing unit (particularly at the front opening of the housing unit) to assist in sealing off air which otherwise might circulate into the storage space of the drawer when the drawer cover is not in use. By minimizing the air circulation into the drawer storage space, use of the drawer cover becomes optional.

Cleanup is easy as the storage assembly components may be removed completely and easily from the refrigerator for cleanup and replacement. The corners of the drawers and trays may be rounded to provide for cleaning efficiency. The interior drawer and tray surfaces, as well as the bottom surface of the drawer cover, are smooth (free of ridges, grooves or protrusions) thus preventing the buildup of sticky foods on those surfaces.

Using the stackable mating design as well as fasteners for horizontal grouping, the housing units may be conjoined in a variety of ways according to user preference and available storage space. In this way, the storage system provides a custom storage solution that is both functional and aesthetically pleasing.

Upon removal of the drawer from the housing unit, the drawer becomes portable and may be used as a serving tray with drawer cover. The user may easily replace the drawer to the housing unit by simply sliding the drawer into the housing. Alternatively, the user may remove the entire assembly from the refrigerator or cooling unit and transporting it as a modular unit which has the added benefit of supporting and protecting the drawer and its contents in transit.

The drawer cover is easily liftable and replaceable. It may be made of a variety of silicone, plastic, rubber, vinyl or similar materials used in the industry which are durable, flexible, transparent and are easily cleaned. Such materials are particularly helpful in securing a substantially air tight seal when the cover seated on the peripheral support edge of the drawer and/or the peripheral top edges of any trays positioned within the drawer.

One of the major benefits associated with use include reduction of disposable bags and other containers the need for which is essentially alleviated with the present system. Access to stored foods is quick and easily in part because the system provides a designated storage area and because the system provides many ease of retrieval features as described above. The system saves time for the user in navigating through refrigerator clutter, as well as by saving the user from having to search for lids to match trays. The modular design is flexible in system can be easily expanded and each assembly can be used as both a permanent or semi-permanent feature and/or taken along as a mobile unit. If something breaks, it can be easily fixed or replaced without replacing the entire system. The drawer/tray components work together to maximize flexibility and storage space. The drawer cover has features which help insure freshness of stored foods. The drawers have features which allow them to be used to display, serve foods, or store food items. The modular system has a number of applications outside of food storage, including biomedical storage and storage of other items which may not need to be cooled, but which require organization and housing in an easily accessible manner.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. For example, the dimensions of the housing units, drawers, drawer covers, trays, tray lids the overall dimensions of the storage system may be varied. Thus, the scope of the present invention should not be limited to the structures described herein, but only by the structures described by the language of the claims and the equivalents of those structures.

What is claimed is:

1. A food storage system comprising:

one or more modular assemblies having a housing unit having top, bottom, sides and back each having interior and exterior surfaces and defining an interior space wherein the interior surfaces accept one or more drawers, the one or more drawers having an interior portion with front, back, bottom and sides each having interior and exterior surfaces and defining an interior storage space and having a drawer top peripheral edge and a drawer peripheral support edge, the one or more drawers being accessible from a substantially open top and configured to receive a plurality of trays, each of the drawer front, back and sides having a top and bottom edge, one or more drawer covers having bottom and top surfaces manufactured from a translucent material selected from the group consisting of silicone, rubber or vinyl, one or more trays positioned within the one or more drawers, each tray having a front, back, bottom and sides and defining an interior storage space and having a tray top peripheral edge, wherein the tray top peripheral edge of the one or more trays is substantially the same height as the drawer peripheral support edge of the one or more drawers when the one or more trays are positioned within the interior storage space of the one or more drawers, wherein the bottom surface of each of the one or more drawer covers is smooth and seals the drawer peripheral support edge of the one or more drawers as well as the tray top peripheral edge of the one or more trays positioned within the storage space of the one or more drawers via direct contact between the bottom surface of the drawer covers and the top peripheral edges of the trays; wherein each drawer cover is able to seal the drawer peripheral support edge and the tray top peripheral edges regardless of the shape or dimension of the tray top peripheral edges; and wherein the one or more drawer covers are configured to be removed from the housing.

2. The system of claim 1 wherein the bottom side of the housing unit is substantially open with rails extending inward from the sides and extending continuously longitudinally from the front to back defining a drawer support edge configured to support one or more drawers.

3. The system of claim 1 wherein the exterior surface of the bottom side of the housing unit has two or more feet extending downward from the bottom surface of the housing and configured for insertion into corresponding receptacles provided in the top surface of the housing unit.

4. The system of claim 1 wherein the exterior surface of the top side of the housing unit has one or more receptacles configured for accepting one or more corresponding feet of a separate modular assembly placed thereon.

5. The system of claim 1 wherein the housing unit sides define one or more ventilation openings positioned between the top and bottom edges of the one or more sides.

6. The system of claim 1 wherein the drawer top peripheral edge of the one or more drawers extends outward and longitudinally along each side to form a lip extending continuously from front to back upon which the drawer may be supported within the housing.

7. The system of claim 1 wherein the housing unit has one or more rails having a drawer support edge extending inward from the interior surface of each side and are configured for supporting the one or more drawers at the drawer support edge when the one or more drawers are positioned within the housing unit.

8. The system of claim 7 wherein the interior surface of each side of the housing unit has one or more wheels configured for applying pressure onto the top surface of the drawer cover to seal the drawer cover to the drawer peripheral support edge as the drawer is slid back into the housing unit.

9. The system of claim 1 wherein the cover for the one or more drawers is flexible material to allow enough lateral flexibility along the length of the cover from front to back to allow a portion of the drawer cover to be lifted upwards to access the drawer contents without disengaging the seal between the bottom of the drawer cover and the drawer peripheral support edge of the remaining portion of the drawer.

10. The method of claim 9 wherein the one or more covers of the one or more drawers is configured to have enough lateral strength to maintain the seal between the cover and the drawer peripheral support edge even when no trays are present within the drawer.

11. The system of claim 1 wherein the front side of the one or more drawers is substantially transparent to allow users to view the drawer contents when the one or more drawers is inserted fully within the housing.

12. The system of claim 1 wherein the cover of the one or more drawers has a uniform bottom surface configured for sealing the drawer peripheral support edge of the one or more drawers when no trays are placed therein.

13. The system of claim 1 wherein each of the one or more trays has a tray peripheral support edge and is configured for accepting a tray lid so that the tray lid does not extend above the tray peripheral support edge of the one or more trays.

14. The system of claim 1, wherein the one or more trays has a shape that is one of square, rectangular, circular, elliptical, trapezoidal and triangular.

15. The system of claim 1 in which the two of more modular assemblies are configured to be easily stackable.

16. The system of claim 1 in which the one or more modular assemblies are detachably mated to one another using a temporary mating mechanism.

17. A method for storing food using a food storage system comprising one or more modular assemblies having a housing unit having tip, bottom, sides and back each having interior and exterior surfaces and defining an interior space wherein the interior surfaces accept one or more drawers, the one or more drawers having an interior portion with front, back, bottom and sides each having interior and exterior surfaces and defining an interior storage space and having a drawer top peripheral edge and a drawer peripheral support edge, the one or more drawers being accessible from a substantially open top and configured to receive a plurality of trays, each of the drawer front, back and sides having a top and bottom edge, one or more drawer covers having bottom and top surfaces manufactured from a translucent material selected from the group consisting of silicone, rubber or vinyl, one or more trays positioned within the one or more drawers, each tray having a front, back, bottom and sides and defining an interior storage space and having a tray to peripheral edge, wherein the tray tp peripheral edge of the one or more trays is substantially the same height as the drawer peripheral support edge of the one or more drawers when the one or more trays are positioned within the interior storage space of the one or more drawers, wherein the bottom surface os each of the one or more drawers is smooth and seals the drawer peripheral support edge of the one or more drawers as well as the tray top peripheral edge of the one or more trays positioned within the storage space of the one or more drawers via direct contact between the bottom surface of the drawer covers and the top peripheral edges of the trays; wherein each drawer cover is able to seal the drawer peripheral support edge and the tray top peripheral edges regardless of the shape or dimensions of the tray top peripheral edges; and wherein the one or more drawer covers are configured to be removed from the housing, consisting of the following steps:

positioning one or more modular assemblies on a shelf of a refrigerator, placing food in one or more trays, sliding a drawer out of the housing unit and lifting a portion of the flexible drawer cover to access the interior storage space of the drawers without dislodging the seal between the remaining portion of the flexible drawer cover and the drawer, positioning the one or more trays in the drawer, placing the cover down on the drawer, and sliding the drawer back into the housing unit.

18. The method of claim 17 including additional step:

Lifting a portion of the drawer cover upwards to access the contents within the drawer while maintaining a seal between the bottom surface of the drawer cover and the drawer peripheral support edge of a remaining portion of the drawer cover.

19. A method for removing food stored in a storage system comprising one or more modular assemblies having a housing unit having tip, bottom, sides and back each having interior and exterior surfaces and defining an interior space wherein the interior surfaces accept one or more drawers, the one or more drawers having an interior portion with front, back, bottom and sides each having interior and exterior surfaces and defining an interior storage space and having a drawer top peripheral edge and a drawer peripheral support edge, the one or more drawers being accessible from a substantially open top and configured to receive a plurality of trays, each of the drawer front, back and sides having a top and bottom edge, one or more drawer covers having bottom and top surfaces manufactured from a translucent material selected from the group consisting of silicone, rubber or vinyl, one or more trays positioned within the one or more drawers, each tray having a front, back, bottom and sides and defining an interior storage space and having a tray to peripheral edge, wherein the tray tp peripheral edge of the one or more trays is substantially the same height as the drawer peripheral support edge of the one or more drawers when the one or more trays are positioned within the interior storage space of the one or more drawers, wherein the bottom surface os each of the one or more drawers is smooth and seals the drawer peripheral support edge of the one or more drawers as well as the tray top peripheral edge of the one or more trays positioned within the storage space of the one or more drawers via direct contact between the bottom surface of the drawer covers and the top peripheral edges of the trays; wherein each drawer cover is able to seal the drawer peripheral support edge and the tray top peripheral edges regardless of the shape or dimensions of the tray top peripheral edges; and wherein the one or more drawer covers are configured to be removed from the housing, consisting of the following steps:

sliding a drawer partially out of the housing unit, lifting the drawer cover by holding a drawer cover handle connected with the drawer cover and lifting longitudinally to provide access to a portion of the interior of the drawer defined anywhere along the entire length of the drawer from front to back, and removing contents from the drawer without disengaging the seal between the bottom of the drawer cover and the drawer peripheral support edge along the remaining portion of the drawer.

* * * * *